US009249531B2

(12) United States Patent
Zenoni et al.

(10) Patent No.: US 9,249,531 B2
(45) Date of Patent: Feb. 2, 2016

(54) TENSION-CONTROLLING METHOD FOR A YARN UNWINDING FROM A STORAGE YARN FEEDER TO A TEXTILE MACHINE

(71) Applicant: L.G.L. ELECTRONICS S.P.A., Gandino (IT)

(72) Inventors: Pietro Zenoni, Leffe (IT); Luca Gotti, Albino (IT)

(73) Assignee: L.G.L. ELECTRONICS S.P.A. (IT)

( * ) Notice: Subject to any disclaimer, the term of this patent is extended or adjusted under 35 U.S.C. 154(b) by 411 days.

(21) Appl. No.: 13/905,361

(22) Filed: May 30, 2013

(65) Prior Publication Data

US 2013/0327877 A1 Dec. 12, 2013

(30) Foreign Application Priority Data

Jun. 4, 2012 (IT) ..... TO2012A0487

(51) Int. Cl.

| | |
|---|---|
| ***B65H 51/22*** | (2006.01) |
| ***B65H 59/06*** | (2006.01) |
| ***D04B 15/44*** | (2006.01) |
| ***D04B 15/48*** | (2006.01) |
| ***D03D 47/36*** | (2006.01) |
| ***B65H 59/10*** | (2006.01) |
| ***D03D 47/34*** | (2006.01) |

(52) U.S. Cl.

CPC ..... *D04B 15/484* (2013.01); *B65H 51/22* (2013.01); *B65H 59/06* (2013.01); *B65H 59/10* (2013.01); *D03D 47/347* (2013.01); *D03D 47/364* (2013.01); *D03D 47/367* (2013.01); *D04B 15/44* (2013.01); *D04B 15/482* (2013.01); *B65H 2701/31* (2013.01)

(58) Field of Classification Search

CPC .... B65H 51/22; B65H 2701/31; B65H 59/06; D04B 15/48; D04B 15/482; D04B 15/44; D03D 47/364; D03D 47/365; D03D 47/47366

See application file for complete search history.

(56) References Cited

FOREIGN PATENT DOCUMENTS

| | | | |
|---|---|---|---|
| CN | 1435520 | A | 8/2003 |
| CN | 101376474 | A | 3/2009 |
| CN | 101942738 | A | 1/2011 |
| EP | 0176987 | B1 | 4/1989 |
| EP | 0 622 485 | A1 * | 11/1994 |
| EP | 0662485 | A2 | 7/1995 |
| EP | 1059375 | A1 | 12/2000 |
| EP | 2031106 | A1 | 3/2009 |

OTHER PUBLICATIONS

Chinese Examination Report for corresponding application 201310079010.4; Report dated Aug. 27, 2015.

* cited by examiner

*Primary Examiner* — William E Dondero
(74) *Attorney, Agent, or Firm* — Cantor Colburn LLP

(57) ABSTRACT

The yarn tension is modulated by a yarn-braking device controlled by a control unit which receives signals of measured tension from a tension sensor and compares them with a reference tension signal in a control loop; as long as the reference tension remains unchanged, a first set of coefficients is used in the control loop causing the control loop to have a relatively slow behavior in relation to the error-compensating action; when a change in the reference tension occurs, the system switches to a second set of coefficients causing the control loop to have a relatively fast behavior; the second set of coefficients is maintained as long as the difference between the second value of the reference tension and the measured tension remains greater or equal to a predetermined minimum value, then the system switches again to the first set of coefficients.

11 Claims, 1 Drawing Sheet

Fig. 1
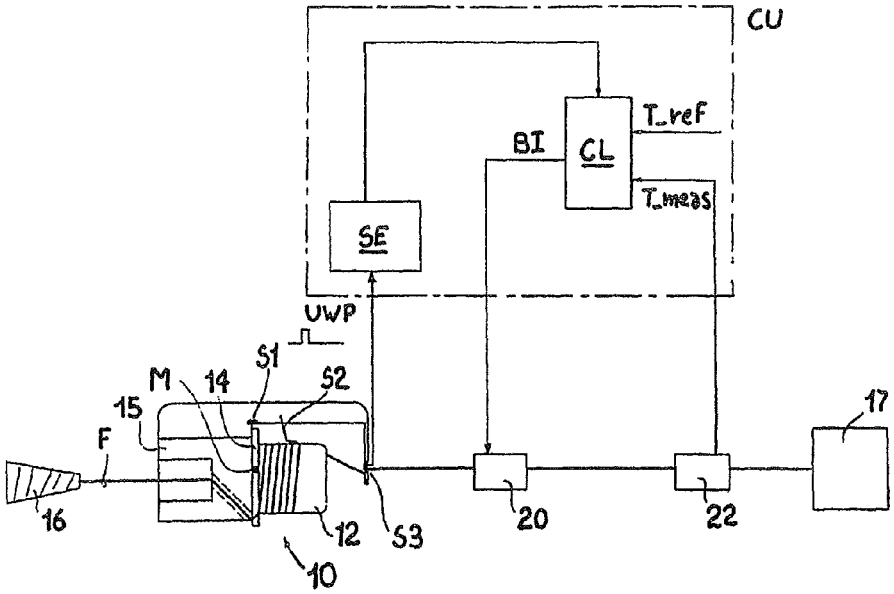
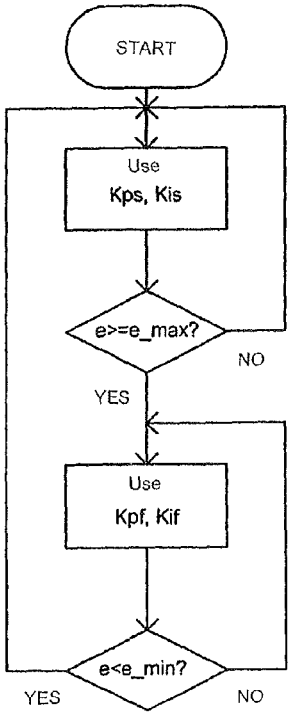
Fig. 2
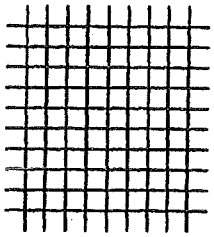
Fig. 3
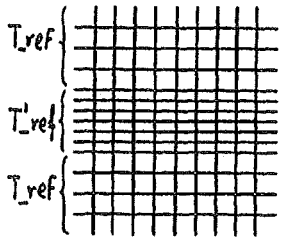
Fig. 4

TENSION-CONTROLLING METHOD FOR A YARN UNWINDING FROM A STORAGE YARN FEEDER TO A TEXTILE MACHINE

The present invention relates to a tension-controlling method for a yarn unwinding from a storage yarn feeder to a textile machine.

BACKGROUND OF THE INVENTION

So called "negative" storage yarn feeders are known, which are provided with a stationary drum on which a motorized swivel arm winds a plurality of yarn loops forming a stock. Upon request from a downstream textile machine, e.g., a conventional circular/rectilinear knitting machine, the yarn loops are unwound from the drum, then the yarn passes through a controlled yarn-braking device which modulates its tension in order to maintain it substantially constant on a predetermined value, and finally is fed to the machine.

With yarn-braking devices such as the one disclosed in EP-B-622 485, the yarn is pressed between a stationary plate and a movable braking member, which is also shaped as a plate and is driven by a linear motor. With yarn-braking devices such as the one disclosed in EP-B-1 059 375, the unwinding yarn is pressed between the delivery edge of the drum and a hollow, frustoconical braking member connected to a motor. In any cases, the motor driving the braking member is controlled by a control unit provided with a closed control loop, which receives a measured tension signal from a tension sensor arranged downstream of the feeder, compares it with a reference tension representing a desired tension, and modulates the braking action in such a way as to minimize the difference between the measured tension and the reference tension.

The conventional control systems are designed to compensate for slow changes in the tension, which may be generated, e.g., by the wear of the braking members, and are tuned in such a way as to be substantially indifferent to any small, sudden variations of tension, which may be generated, e.g., by a node or by a portion of yarn having an irregular thickness. To this purpose, the control loop is set to a very low frequency band, even below 0.1 Hz.

It is also known from EP2031106 to enable the control loop only when the yarn consumption speed exceeds a predetermined threshold value, in order to prevent the control system from operating improperly during particular operative conditions, e.g., at the start of the weaving process, when the knitting machine is not running yet, or during the insertion step, when the yarn is not running.

Although the known control systems are satisfactory for those applications in which the reference tension is rarely, or even never, changed during processing, they are not suitable to those applications in which the reference tensions are frequently changed at short time intervals during processing, e.g., in order to produce meshes having particular fancy patterns. In fact, due to the very low frequency band, several seconds are required to align the yarn tension to the new value, but this delay is not acceptable with the above processes.

Therefore, nowadays these processes can be only performed on expensive knitting machines which allow the stitch cams to be adjusted, while they cannot be carried out on less sophisticated, older machines which do not have this function.

SUMMARY OF THE INVENTION

Therefore, it is a main object of the invention to provide a tension-controlling method for a yarn unwinding from a storage yarn feeder, which is substantially indifferent to occasional tension peaks which may be due, e.g., to a node or to a portion of yarn having an irregular thickness, but which is also capable of quickly adjusting the feeding tension in relation to any variations of the reference tension.

BRIEF DESCRIPTION OF THE DRAWINGS

The invention will be now described in more detail with reference to a few preferred, non-exclusive embodiments, shown by way of non limiting example in the attached drawings, wherein:

FIG. 1 diagrammatically shows an apparatus for carrying out the method according to the invention;

FIG. 2 is a flowchart describing the steps of the method according to an embodiment of the invention;

FIG. 3 is a plan view of a portion of mesh produced by maintaining the yarn tension substantially constant during processing;

FIG. 4 is a plan view of a portion of mesh produced by varying the yarn tension during processing.

DESCRIPTION OF THE PREFERRED EMBODIMENTS

With initial reference to FIG. 1, a yarn feeder 10 for textile machines comprises a stationary drum 12 and a flywheel 14 driven to rotate by a motor 15, which draws yarn F from a reel 16 and winds it on drum 12 in the shape of yarn loops forming a weft stock. Upon request from a general textile machine 17, the yarn is unwound from drum 12 and is fed to the machine.

The amount of yarn stored on drum 12 is controlled by a triad of sensors. A first sensor S1, preferably a Hall sensor, detects the passages of magnets such as M integral with flywheel 14, in order to determine the amount of yarn wound on the drum and the winding speed. A second sensor S2, preferably a mechanical sensor, generates a binary information indicative of the presence of a minimum amount of yarn at an intermediate position of drum 12. A third sensor S3, preferably an optical sensor, provides one pulse UWP per each loop unwound from the drum.

A yarn-braking device 20 arranged downstream of drum 12 of yarn feeder 10, is controlled by a control unit CU—which will be described in more detail below—in order to control the tension of the yarn unwinding from drum 12 in such a way as to maintain it substantially constant.

A tension sensor 22 arranged downstream of yarn-braking device 20 measures the tension of yarn F unwinding from the drum and generates a measured tension signal T_meas.

Control unit CU receives measured tension signal T_meas and compares it, in a control loop CL which will be described in more detail below, with a reference tension T-ref representing the desired tension, in order to generate braking commands BI for yarn-braking device 20, which are adapted to minimize the difference or error, e, between the measured tension and the reference tension.

Control loop CL is normally disabled, and control unit CU comprises a speed-evaluating block SE which processes signals UWP from third sensor S3 in order to calculate the actual yarn comsumption speed on the basis of the time interval between pulses UWP, and is programmed to generate an enabling signal LE which enables control loop CL only when such speed exceeds a predetermined threshold value, which can also be equal to zero.

On the contrary, when the calculated speed is below the threshold value, control loop CL is disabled and braking signal BI remains "freezed" on the value stored in the memory at the previous instant, until the speed will exceed the threshold value again and the tension control block will start to control again by using the freezed value as the first value.

Alternatively, in order to calculate the yarn-winding speed, speed-evaluating block SE can process the signals from first sensor S1 based on the time interval between the pulses generated by this sensor, and can be programmed to generate an enabling signal LE, which enables tension control block TC, only when this speed exceeds a threshold value which can also be equal to zero. On the contrary, when the calculated speed is below the threshold value, tension control block TC is disabled and braking signal BI remains "freezed" on the value BIf stored in the memory at the previous instant, until the speed will exceed the minimum value and the tension control block will start to control again by using the freezed value as the first value.

Control loop CL is provided with a proportional-integral controller PI whose error correction e, as known, is defined by the formula $$Kpe+\int Kie(t)dt$$

wherein Kp is the proportional gain coefficient and Ki is the integral gain coefficient.

According to the invention, coefficients Kp and Ki used by control loop CL are not fixed, i.e., as long as reference tension T_ref remains unchanged, a first pair of coefficients Kps and Kis are used, which provide control loop with a relatively slow behaviour in relation to the correction of the error, so that it will be indifferent to occasional perturbations; when the reference tension is changed—from a first value T_ref to a second value T'_ref—control loop CL uses a second pair of coefficients Kpf and Kif which provide it with a relatively fast behaviour, so that it will quickly reach the new required reference tension value T'_ref; control loop CL will maintain the new coefficients Kpf and Kif until the absolute value of the difference between the new reference tension T'_ref and measured tension T_meas is higher than a predetermined value, then it will switch again to the first pair of coefficients Kps, Kis.

In other words, after that control unit CU has switched to the second pair of coefficients Kpf, Kif, switching back to the first pair of coefficients Kps, Kis is based on comparing the absolute value of error e with a minimum, predetermined error e_min, according to the following logic:

- if e≥e_min, then the second pair of coefficients Kpf, Kif corresponding to the fast control is maintained;
- if e<e_min, then the control unit switches back to the first pair of coefficients Kps, Kis corresponding to the slow control.

The value of e_min is preferably in the range 0.15 to 0.4 g.

Moreover, both the ratio Kpf/Kps and the ratio Kif/Kis are preferably in the range 5 to 50, and more advantageously are equal to 16.

More generally, the first pair of coefficients Kps, Kis is preferably chosen in such a way that the resulting, equivalent frequency band of the control loop falls within the range 0.01 to 2 Hz, while the second pair of coefficients Kpf, Kif is chosen in such a way that the resulting, equivalent frequency band of the control loop falls within the range 4 to 20 Hz.

In a first embodiment of the invention, which is described in the flowchart of FIG. 2, the switching from the first pair of coefficients Kps, Kis to the second pair of coefficients Kpf, Kif—which is determined by a change in the reference tension—is based on the comparison between the absolute value of error e and a predetermined maximum error e_max, in a way similar to the switching from the second pair of coefficient to the first one, according to the following logic:

- if e<e_max, then the first pair of coefficients Kps, Kis corresponding to the slow controlling action is maintained;
- if e≥e_max, then the control unit switches to the second pair of coefficients Kpf, Kif corresponding to the fast controlling action.

The value of e_min, which indicates the threshold for switching from the fast control to the slow control, is advantageously equal to the value of e_max, which indicates the threshold for switching from the slow control to the fast control in the above embodiment.

In an alternative embodiment of the invention, the switching from the first pair of coefficients Kps and Kis to the second pair of coefficients Kpf and Kif is directly activated by the command which sets the new reference tension value, without performing any comparison during this step.

As the person skilled in the art will immediately understand, the method according to the invention allows particular processes, which require frequent changes in the reference tension at short time intervals during processing, to be carried out even on relatively inexpensive and simple machines which are not provided with the function of adjusting the stitch cams, so that purchasing a more sophisticated dedicated machine is not required.

A few preferred embodiments of the invention have been described herein, but of course many changes may be made by a person skilled in the art within the scope of the claims. In particular, using the method already described in EP2031106 of enabling/disabling the control block as a function of the yarn comsumption speed, in association with the method according to the invention should be understood as a useful solution, which however is not indispensable because the two methods are independent from each other and, therefore, can be used separately. Of course, the method of the invention can be applied to other types of storage feeders, e.g., feeders which are not provided with a yarn-winding flywheel but with a drum which can rotate for winding the yarn coming from the reel upon itself.

What is claimed is:

1. A tension-controlling method for a yarn unwinding from a yarn feeder to a textile machine, in which the yarn tension is modulated by a yarn-braking device controlled by a control unit which receives signals of measured tension from a tension sensor and compares them with a predetermined reference tension signal in a control loop which generates a braking signal adapted to minimize the difference between them, said control loop being provided with a proportional-integral controller whose error-compensating action is defined by the formula $$Kpe+\int Kie(t)dt$$

where Kp is a proportional gain coefficient, Ki is an integral gain coefficient, and e represents the difference between said signal of measured tension and said reference tension signal, wherein it comprises the steps of:

- as long as the reference tension remains unchanged, using a first proportional gain coefficient and a first integral gain coefficient in the control loop causing the control loop to have a relatively slow behaviour in relation to the compensation of the error,
- when a change in the reference tension occurs, from a first value to a second value, switching to a second proportional gain coefficient and a second integral gain coefficient causing the control loop to have a relatively fast behaviour in relation to the compensation of the error, and maintaining said second proportional gain coefficient and said second integral gain coefficient as long as the difference between said second value of the reference tension and said measured tension remains greater or equal to a predetermined minimum value, then switching back to said first proportional gain coefficient and said first integral gain coefficient.

2. The method of claim 1, wherein said predetermined minimum value is in the range 0.15 g to 0.4 g.

3. The method of claim 1, wherein the ratio of the second proportional gain coefficient to the first proportional gain coefficient is in the range 5 to 50.

4. The method of claim 3, wherein the ratio of the second proportional gain coefficient to the first proportional gain coefficient is equal to 16.

5. The method of claim 1, wherein the ratio of the second integral gain coefficient to the first integral gain coefficient is in the range 5 to 50.

6. The method of claim 5, wherein the ratio of the second integral gain coefficient to the first integral gain coefficient is equal to 16.

7. The method of claim 1, wherein said first proportional gain coefficient and said first integral gain coefficient are is maintained as long as the difference between said reference tension and said measured tension is lower than a predetermined maximum value, and switches to said second proportional gain coefficient and said second integral gain coefficient when said difference exceeds said predetermined maximum value.

8. The method of claim 7, wherein said predetermined maximum value is in the range 0.15 g to 0.4 g.

9. The method of claim 1, wherein said first proportional gain coefficient and said first integral gain coefficient directly switches to said second proportional gain coefficient and said second integral gain coefficient when a new value of said reference tension is set.

10. The method of claim 1, wherein said first proportional gain coefficient and said first integral gain coefficient are selected such that an equivalent frequency band of the control loop is in the range 0.01 Hz to 2 Hz.

11. The method of claim 1, wherein said second proportional gain coefficient and said second integral gain coefficient are selected such that an equivalent frequency band of the control loop is in the range 4 Hz to 20 Hz.

* * * * *